US009570820B2

(12) United States Patent
Guo et al.

(10) Patent No.: US 9,570,820 B2
(45) Date of Patent: Feb. 14, 2017

(54) COAXIAL CONNECTOR AND CONNECTING TERMINAL THEREOF

(71) Applicant: Sunway Communication (Beijing) Co., Ltd., Beijing (CN)

(72) Inventors: Jianguang Guo, Beijing (CN); Hongwei Zhang, Beijing (CN); Nan Jiang, Beijing (CN)

(73) Assignee: SUNWAY COMMUNICATION (BEIJING) CO., LTD., Beijing (CN)

( * ) Notice: Subject to any disclaimer, the term of this patent is extended or adjusted under 35 U.S.C. 154(b) by 48 days.

(21) Appl. No.: 14/527,818

(22) Filed: Oct. 30, 2014

(65) Prior Publication Data

US 2015/0064967 A1 Mar. 5, 2015

(30) Foreign Application Priority Data

Aug. 30, 2013 (CN) ..... 2013 2 0538495 U

(51) Int. Cl.

| | |
|---|---|
| ***H01R 9/05*** | (2006.01) |
| ***H01R 4/02*** | (2006.01) |
| *H01R 4/18* | (2006.01) |
| *H01R 13/11* | (2006.01) |

(52) U.S. Cl.

CPC ..... *H01R 9/0518* (2013.01); *H01R 4/023* (2013.01); *H01R 4/185* (2013.01); *H01R 4/187* (2013.01); *H01R 13/111* (2013.01)

(58) Field of Classification Search

CPC ..... H01R 9/0518; H01R 9/05; H01R 4/023; H01R 4/185; H01R 4/187; H01R 13/111

USPC ..... 439/585

See application file for complete search history.

(56) References Cited

U.S. PATENT DOCUMENTS

| | | | | |
|---|---|---|---|---|
| 4,966,565 | A | 10/1990 | Dohi | |
| 5,186,656 | A * | 2/1993 | Harwath | H01R 24/40 439/585 |
| 6,971,913 | B1 | 12/2005 | Chu | |
| 2006/0160419 | A1 | 7/2006 | Wang | |
| 2010/0087091 | A1 | 4/2010 | Chen | |
| 2010/0112857 | A1 * | 5/2010 | Bianchi | H01R 4/183 439/585 |
| 2013/0149887 | A1 | 6/2013 | Chen | |

FOREIGN PATENT DOCUMENTS

| | | |
|---|---|---|
| CN | 202352863 | 7/2012 |
| JP | H03210776 | 9/1991 |
| JP | H0785901 | 3/1995 |
| JP | H08185914 | 7/1996 |
| JP | 2004087410 | 3/2004 |
| JP | 2004241246 | 8/2004 |
| WO | 2013038825 | 3/2013 |

* cited by examiner

*Primary Examiner* — Javaid Nasri
(74) *Attorney, Agent, or Firm* — Hodgson Russ LLP

(57) ABSTRACT

A coaxial connector and a connecting terminal thereof are provided. The connecting terminal includes a terminal body having a solder cup and defining a first end and a second end in a longitudinal direction of the terminal body; a pair of first clamping paws disposed at the first end of the terminal body, opposed to each other in a transverse direction of the terminal body, and adjacent to the solder cup; and a pair of second clamping paws disposed at the second end of the terminal body and opposed to each other in the transverse direction. The connecting terminal of the coaxial connector is high in reliability when being connected with a coaxial cable.

6 Claims, 4 Drawing Sheets

COAXIAL CONNECTOR AND CONNECTING TERMINAL THEREOF

CROSS-REFERENCE TO RELATED APPLICATION

This application claims priority to and benefits of Chinese Patent Application Serial No. 201320538495.4, filed with the State Intellectual Property Office of P. R. China on Aug. 30, 2013, the entire content of which is incorporated herein by reference.

FIELD

The present invention relates to a coaxial connector and a connecting terminal thereof.

BACKGROUND

As a common electronic element, a coaxial connector is frequently used to connect coaxial cables. Conventionally, the connection between the coaxial cables and a connecting terminal of the coaxial connector is low in reliability, so there is a need for improvement on the coaxial connector.

SUMMARY

The present invention seeks to solve at least one of the problems existing in the prior art to at least some extent. Therefore, an objective of the present invention is to provide a connecting terminal with high reliability in connecting with a coaxial cable.

Another objective of the present invention is to provide a coaxial connector including the connecting terminal.

To achieve the objectives, a first aspect of the present invention provides a connecting terminal of a coaxial connector. The connecting terminal of the coaxial connector includes a terminal body having a solder cup and defining a first end and a second end in a longitudinal direction of the terminal body; a pair of first clamping paws disposed at the first end of the terminal body, opposed to each other in a transverse direction of the terminal body, and adjacent to the solder cup; and a pair of second clamping paws disposed at the second end of the terminal body and opposed to each other in the transverse direction.

With the connecting terminal of the coaxial connector according to embodiments of the present invention, by providing the terminal body with the solder cup, after the coaxial cable is connected with the connecting terminal, not only can the coaxial cable be limited by the first clamping paws, but also the coaxial cable may be welded on the solder cup of the terminal body, such that the coaxial cable may be tightly and stably connected with the connecting terminal, thereby considerably improving the reliability of the connection between the connecting terminal and the coaxial cable with simple technology and easy operation. Therefore, the connecting terminal of the coaxial connector according to embodiments of the present invention has the advantage of high reliability in connecting with the coaxial cable.

In addition, the connecting terminal of the coaxial connector according to embodiments of the present invention also has the following additional technical features:

The solder cup is a groove formed in an upper surface of the terminal body. Therefore, the coaxial cable can be welded by means of the groove so as to facilitate the fixation of the coaxial cable and the connecting terminal.

The solder cup is a step formed by bending the terminal body. Consequently, the coaxial cable may be connected and fixed with the connecting terminal, which is easier to implement and can enhance connection strength.

The pair of second clamping paws are extended slantwise so that free ends of the pair of second clamping paws are close to each other, and hence the reliability of the connection between the connecting terminal and the coaxial cable may be further improved.

The terminal body, the pair of first clamping paws and the pair of second clamping paws are integrally formed by a metal sheet, which can not only enhance the strength of the connecting terminal, but also simplify the production process of the connecting terminal, thereby reducing the production cost of the connecting terminal.

A second aspect of the present invention provides a coaxial connector. The coaxial connector includes: an outer conductor; an insulating core disposed in the outer conductor, and having an axial hole and a receiving groove communicated with the axial hole; and a connecting terminal according to the first aspect of the present invention received in the receiving groove and for holding a coaxial cable by the pair of first clamping paws, the pair of second clamping paws being inserted into the axial hole.

By using the connecting terminal of the coaxial connector according to the first aspect of the present invention, the coaxial connector according to embodiments of the present invention may be more reliably connected with the coaxial cable for stable transmission of signals. Therefore, the coaxial connector has the advantages of reliable connection with the coaxial cable and stable transmission of signals.

The outer conductor includes a cover plate and a cylindrical fitting ring having a cutout and disposed at an end of the cover plate. Therefore, the insulating core and the connecting terminal can be positioned and mounted, and the assembling of the coaxial connector can be easier and more convenient.

A plurality of fastening paws are formed at each longitudinal edge of the cover plate, which can ensure a stable structure of the coaxial connector and reliable connection between the coaxial connector and the coaxial cable.

The fastening paws include a pair of cable fastening paws for fastening the coaxial cable, a pair of terminal fastening paws for fastening the connecting terminal and a pair of cylindrical fitting ring fastening paws for fastening the cylindrical fitting ring. With such a simple and easy-handling structure, the fastening paw can limit the cylindrical fitting ring, the connecting terminal and the coaxial cable.

The insulating core includes a main body and a tongue extended from the main body, the tongue is sandwiched between the cove plate and the connecting terminal after being bent with the cover plate, which can not only enhance the stability of the connection between the connecting terminal and the insulating core, but also further improve the convenience of assembling the coaxial connector.

BRIEF DESCRIPTION OF THE DRAWINGS

These and other aspects and advantages of the present invention will become apparent and more readily appreciated from the following descriptions made with reference to the drawings, in which.

REFERENCE NUMERALS

Figure 1:
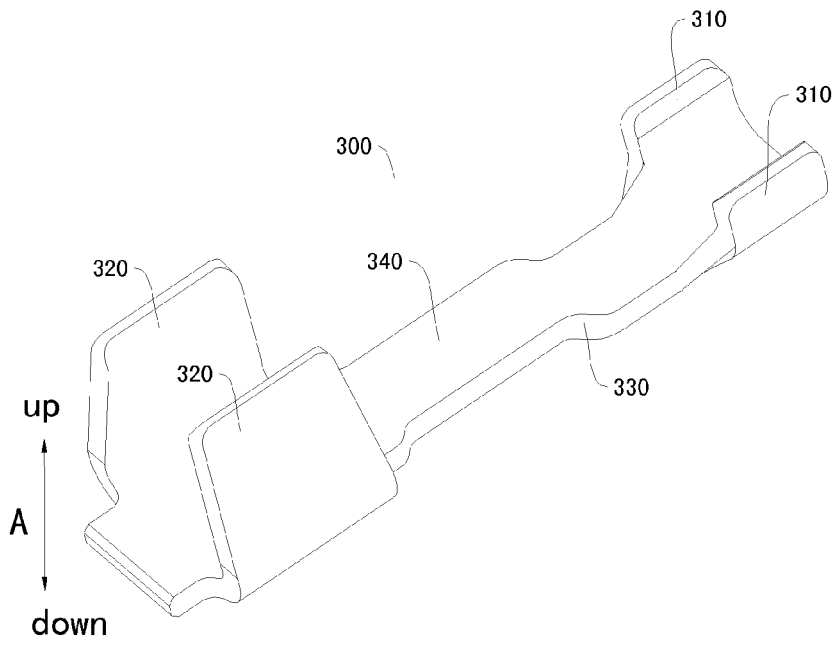
FIG. 1 is a perspective view of a connecting terminal of a coaxial connector according to an embodiment of the present invention.

1 coaxial connector
2 coaxial cable
100 outer conductor
110 cover plate
111 cable fastening paw
112 terminal fastening paw
113 cylindrical fitting ring fastening paw
120 cylindrical fitting ring
121 recess
200 insulating core
210 axial hole
220 tongue
230 projection
300 connecting terminal
340 terminal body
310 first clamping paw
320 second clamping paw
330 solder cup

DETAILED DESCRIPTION

Embodiments of the present invention will be described in detail and examples of the embodiments will be illustrated in the drawings, where same or similar reference numerals are used to indicate same or similar members or members with same or similar functions. The embodiments described herein with reference to drawings are explanatory, which are used to illustrate the present invention, but shall not be construed to limit the present invention.

In the description of the present invention, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise" and "counterclockwise" should be construed to refer to the orientation or position as shown in the drawings under discussion. These relative terms are for convenience of description and do not indicate or imply that the apparatus or members must have a particular orientation or be constructed and operated in a particular orientation. Therefore, these terms shall not be construed to limit the present invention.

In addition, terms such as "first" and "second" are used herein for purposes of description and are not intended to indicate or imply relative importance or significance or to imply the number of indicated technical features. Thus, the feature defined with "first" and "second" may explicitly or implicitly include one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications or interaction of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above" or "on top of" a second feature may include an embodiment in which the first feature is right or obliquely "on," "above" or "on top of" the second feature, or just means that the first feature is at a height higher than that of the second feature; while a first feature "below," "under" or "on bottom of" a second feature may include an embodiment in which the first feature is right or obliquely "below," "under" or "on bottom of" the second feature, or just means that the first feature is at a height lower than that of the second feature.

Figure 2:
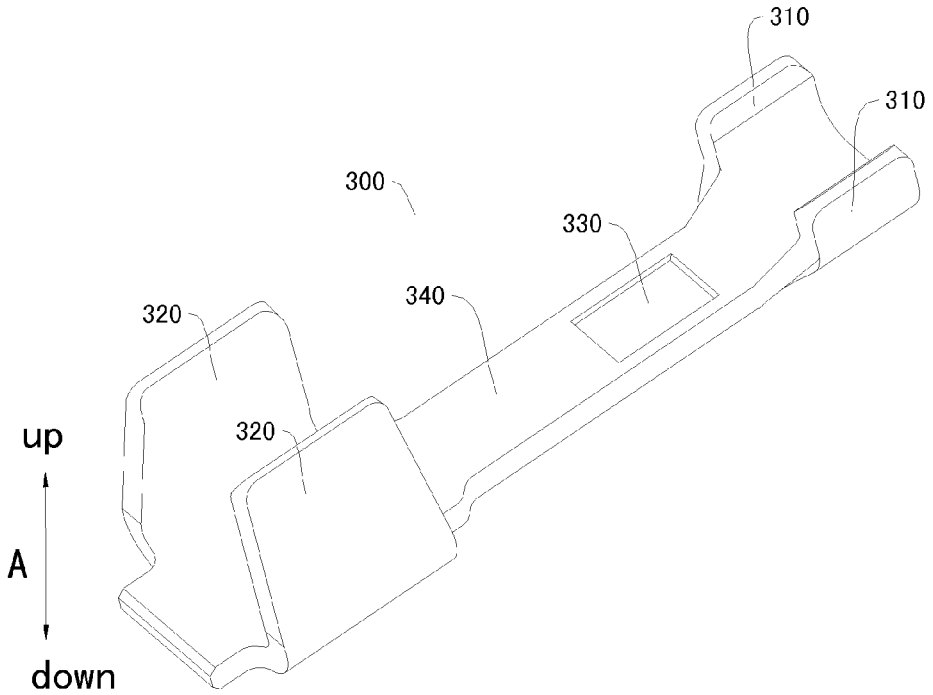
FIG. 2 is a perspective view of a connecting terminal of a coaxial connector according to another embodiment of the present invention.
Figure 3:
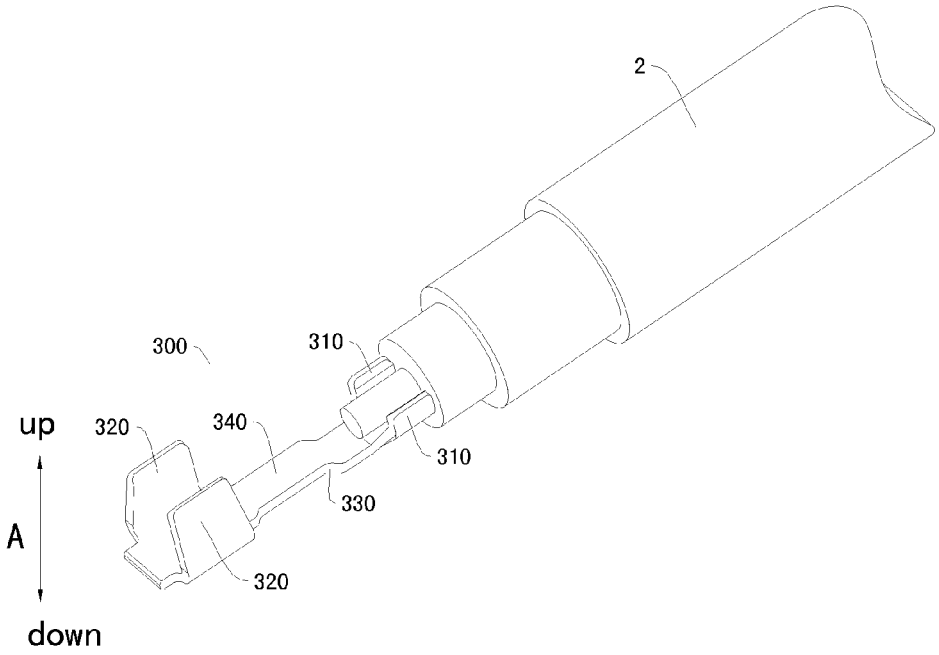
FIG. 3 is a schematic view of the connection between a connecting terminal of a coaxial connector and a coaxial cable according to an embodiment of the present invention.
Figure 4:
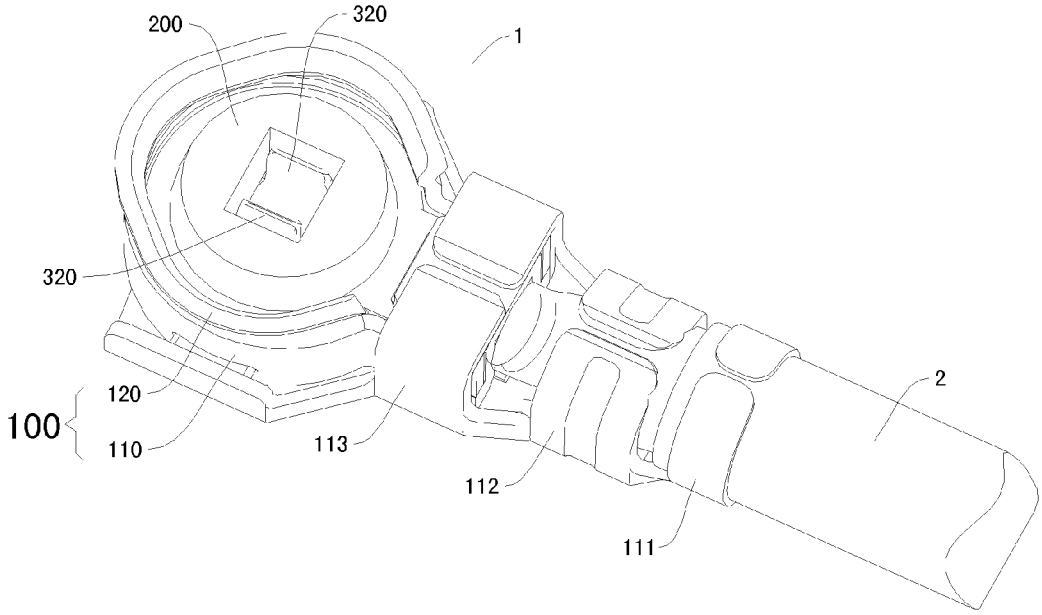
FIG. 4 is a schematic view of the connection between a coaxial connector and a coaxial cable according to an embodiment of the present invention.

In the following, a connecting terminal 300 of a coaxial connector according to an embodiment of the present invention will be described with reference to FIG. 1 to FIG. 3. As shown in FIG. 1 to FIG. 3, the connecting terminal 300 of the coaxial connector according to an embodiment of the present invention includes a terminal body 340, a pair of first clamping paws 310 and a pair of second clamping paws 320.

The terminal body 340 has a solder cup 330 and has a first end and a second end in a longitudinal direction of the terminal body 340. The pair of first clamping paws 310 is disposed at the first end of the terminal body 340, opposed to each other in a transverse direction of the terminal body 340, and adjacent to the solder cup 330. The pair of second clamping paws 320 is disposed at the second end of the terminal body 340 and opposed to each other in the transverse direction of the terminal body 340.

With the connecting terminal 300 of the coaxial connector according to embodiments of the present invention, by providing the terminal body 340 with the solder cup 330, after the coaxial cable 2 is connected with the connecting terminal 300, not only can the coaxial cable 2 be limited by the first clamping paws 310, but also the coaxial cable 2 may be welded on the solder cup 330 of the terminal body 340, such that the coaxial cable 2 may be tightly and stably connected with the connecting terminal 300, thereby considerably improving the reliability of the connection between the connecting terminal 300 and the coaxial cable 2 with simple technology and easy operation. Therefore, the connecting terminal 300 of the coaxial connector according to embodiments of the present invention has the advantage of high reliability in connecting with the coaxial cable 2.

Specifically, as shown in FIG. 2, the solder cup 330 can be a groove formed in an upper surface of the terminal body 340 (the up and down direction is shown by the arrow A in FIGS. 1-3, 5, 6). Therefore, the coaxial cable 2 can be welded by means of the groove so as to facilitate the fixation of the coaxial cable 2 and the connecting terminal 300.

As shown in FIG. 1, the solder cup 330 can also be a step formed by bending the terminal body 340. Consequently, the coaxial cable 2 can be welded by means of the step, so as to connect and fix the coaxial cable 2 and the connecting terminal 300, which is easier to implement and can enhance connection strength.

Alternatively, as shown in FIG. 1 to FIG. 3, the pair of second clamping paws 320 can be extended slantwise so that the free ends of the pair of second clamping paws 320 are close to each other. In other words, the upper ends of two second clamping paws 320 are close to each other. In such a case, when an adaptive connecting terminal is inserted between the two second clamping paws 320, the two second clamping paws 320 can clamp the adaptive connecting terminal, which further improves the reliability of the connection between the connecting terminal 300 and the coaxial cable 2.

Advantageously, the terminal body 340, the pair of first clamping paws 310 and the pair of second clamping paws 320 can be integrally formed by a metal sheet, which can not only enhance the strength of the connecting terminal 300, but also simplify the production process of the connecting terminal 300, thereby reducing the production cost of the connecting terminal 300.

In the following, a coaxial connector 1 according to an embodiment of the present invention will be described with reference to FIG. 4 to FIG. 8. As shown in FIG. 4 to FIG. 8, the coaxial connector 1 according to embodiments of the present invention includes an outer conductor 100, an insulating core 200 and a connecting terminal.

The insulating core 200 is disposed in the outer conductor 100 and has an axial hole 210 and a receiving groove communicated with the axial hole 210. The connecting terminal is the connecting terminal 300 of the coaxial connector according to the above embodiments of the present invention, is received in the receiving groove and holds a coaxial cable by the pair of first clamping paws 310. Moreover, the pair of second clamping paws 320 is inserted into the axial hole 210.

By using the connecting terminal 300 of the coaxial connector according to the above embodiments of the present invention, the coaxial connector 1 according to an embodiment of the present invention may be more reliably connected with the coaxial cable 2 for stable transmission of signals. Therefore, the coaxial connector 1 has the advantages of reliable connection with the coaxial cable 2 and stable transmission of signals.

FIGS. 4-7 show the coaxial connector 1 according to a specific embodiment of the present invention. As shown in FIG. 4 to FIG. 7, the outer conductor 100 can include a cover plate 110 and a cylindrical fitting ring 120 having a cutout and disposed at an end of the cover plate 110. Specifically, the cylindrical fitting ring 120 can be irregularly annular. During the assembling, the insulating core 200 with the connecting terminal 300 can be first disposed in the cylindrical fitting ring 120, and then the joint of the cylindrical fitting ring 120 and the cover plate 110 is bent. Therefore, the insulating core 200 and the connecting terminal 300 can be positioned and mounted, and the assembling of the coaxial connector 1 can be easier and more convenient.

Further, a plurality of fastening paws are formed at each longitudinal edge of the cover plate 110. In such a case, the cylindrical fitting ring 120, the connecting terminal 300 and the coaxial cable 2 can be limited by the fastening paw, which ensures a stable structure of the coaxial connector 1 and reliable connection between the coaxial connector 1 and the coaxial cable 2.

Specifically, as shown in FIG. 4 to FIG. 7, the fastening paws can include a pair of cable fastening paws 111 for fastening the coaxial cable 2, a pair of terminal fastening paws 112 for fastening the connecting terminal 300 and a pair of cylindrical fitting ring fastening paws 113 for fastening the cylindrical fitting ring 120. More specifically, the pair of cable fastening paws 111, the pair of terminal fastening paws 112 and the pair of cylindrical fitting ring fastening paws 113 can be spaced apart from each other and sequentially arranged from one end of the cover plate 110 near the coaxial cable 2 to the other end of the cover plate 110 remote from the coaxial cable 2. The pair of cable fastening paws 111, the pair of terminal fastening paws 112 and the pair of cylindrical fitting ring fastening paws 113 can be each independently in pairs and opposed to each other in a transverse direction of the cover plate 110. A portion of the cylindrical fitting ring 120 can be fastened between the pair of the cylindrical fitting ring fastening paws 113, a portion of the connecting terminal 300 can be fastened between the pair of the terminal fastening paws 112, and a portion of the coaxial cable 2 can be fastened between the pair of the cable fastening paws 111 after the coaxial cable 2 is connected with the coaxial connector 1. With such a simple and easy-handling structure, the fastening paw can limit the cylindrical fitting ring 120, the connecting terminal 300 and the coaxial cable 2.

Figure 5:
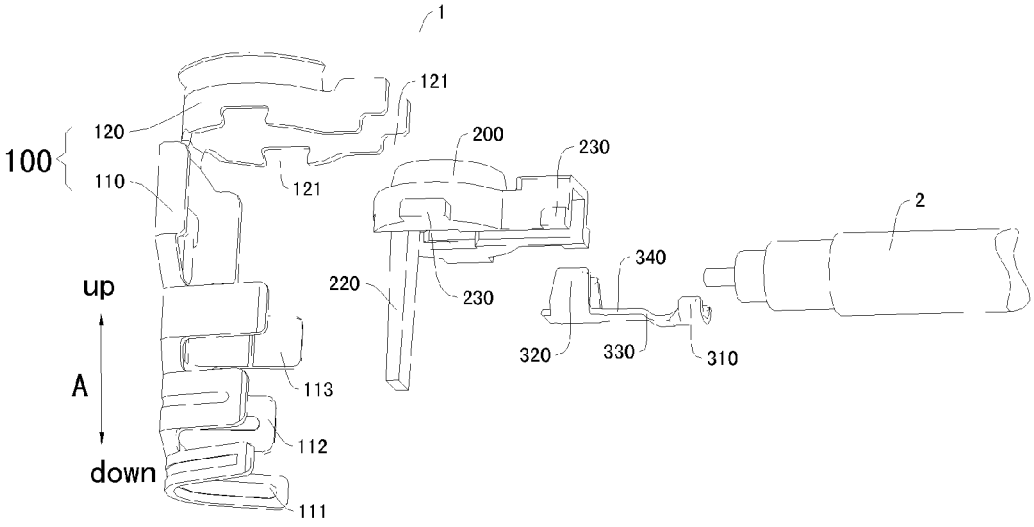
FIG. 5 is an exploded view of a coaxial connector and a coaxial cable according to an embodiment of the present invention.
Figure 6:
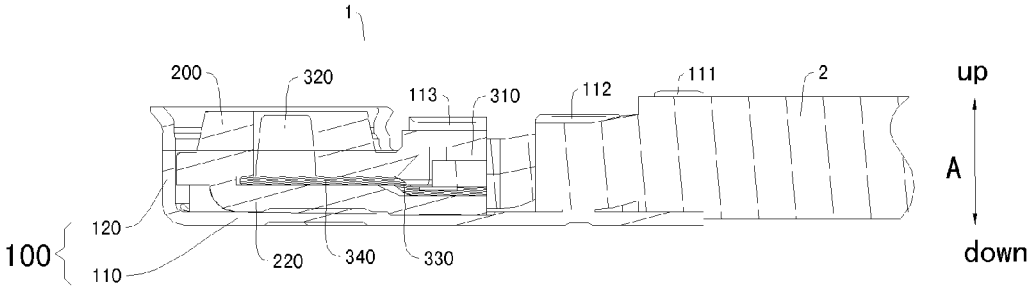
FIG. 6 is a sectional view of a coaxial connector and a coaxial cable according to an embodiment of the present invention.
Figure 7:
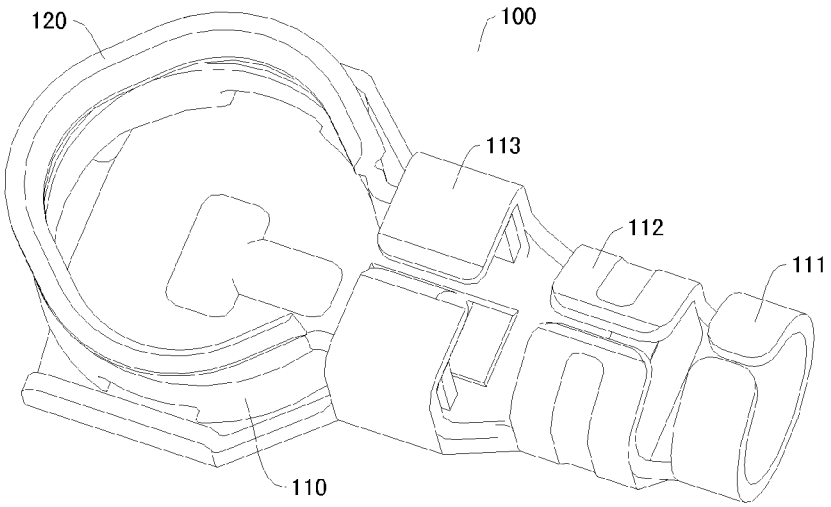
FIG. 7 is a perspective view of an outer conductor of a coaxial connector according to an embodiment of the present invention.

FIG. 5 and FIG. 6 show a coaxial connector 1 according to a specific example of the present invention. As shown in FIG. 5 and FIG. 6, the insulating core 200 can have a main body and a tongue 220 extended from the main body, and the tongue 220 is sandwiched between the cove plate 110 and the connecting terminal 300 after being bent with the cover plate 110. Specifically, the tongue 220 can be folded, and define the receiving groove in the insulating core 200 when it is folded. During the assembling, the tongue 220 can be first unfolded. After the connecting terminal 300 is mounted on the insulating core 200, the tongue 220 can be folded such that the connecting terminal 300 and the insulating core 200 are integrated, which makes it easy to mount the connecting terminal 300 and the insulating core 200 in the outer conductor 100. In other words, by providing the tongue 220, not only the stability of the connection between the connecting terminal 300 and the insulating core 200, but also the convenience of assembling the coaxial connector 1 can be improved.

Figure 8:
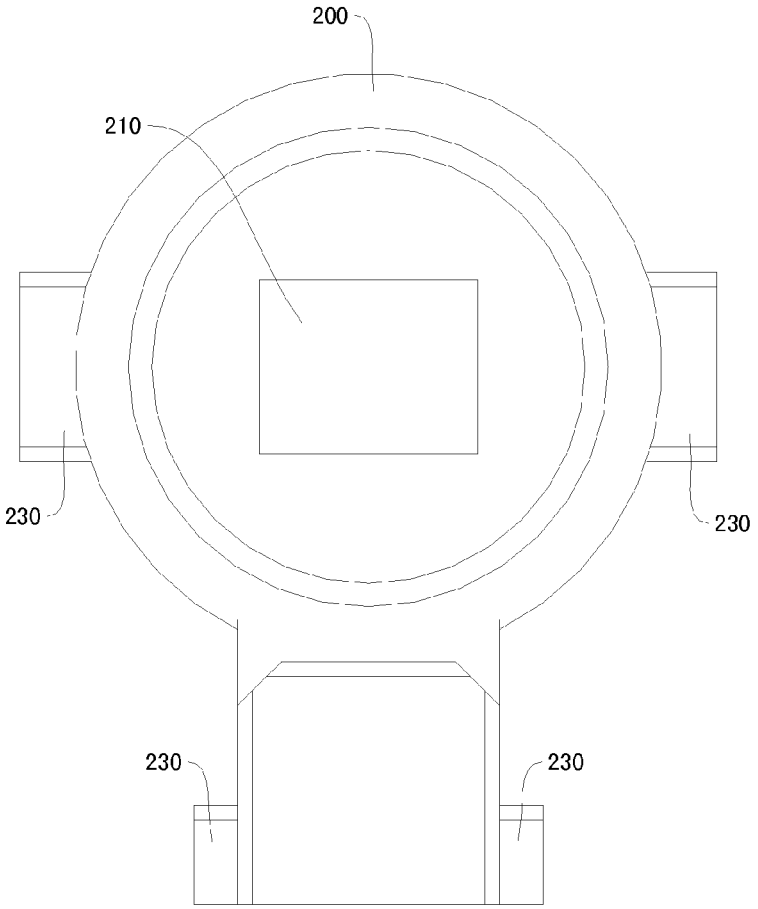
FIG. 8 is a schematic top view of an insulating core of a coaxial connector according to an embodiment of the present invention.

Advantageously, as shown in FIG. 5 and FIG. 8, the cylindrical fitting ring 120 can be formed with four recesses 121, and the insulating core 200 is further provided with four projections 230 which are correspondingly engaged in the four recesses 121, thereby further improving the stability of the connection between the insulating core 200 and the outer conductor 100.

Reference throughout this specification to "an embodiment," "some embodiments," "examples," "specific examples," or "some examples" means that a particular feature, structure, material, or characteristic described in connection with the embodiment or example is included in at least one embodiment or example of the present invention. Thus, these terms throughout this specification do not necessarily refer to the same embodiment or example of the present invention. Furthermore, the particular features, structures, materials, or characteristics may be combined in any suitable manner in one or more embodiments or examples. In addition, those skilled in the art can combine different embodiments or examples described in the specification.

Although embodiments of the present invention have been shown and described, it would be appreciated by those skilled in the art that the above embodiments cannot be construed to limit the present invention, and changes, modifications, alternatives and variations can be made in the embodiments without departing from the scope of the present invention.

What is claimed is:

1. A connecting terminal of a coaxial connector, comprising:

a terminal body having a solder cup and defining a first end and a second end in a longitudinal direction of the terminal body, the solder cup being shaped to hold solder for soldering a conductive core of the coaxial connector to the terminal body for transmission of signals through the connecting terminal;

a pair of first clamping paws disposed at the first end of the terminal body, opposed to each other in a transverse direction of the terminal body, and adjacent to the solder cup, the pair of first clamping paws being configured to clamp against the conductive core of the coaxial connector for transmission of signals through the connecting terminal; and a pair of second clamping paws disposed at the second end of the terminal body and opposed to each other in the transverse direction;

wherein the solder cup is a step formed by bending the terminal body.

2. The connecting terminal of the coaxial connector according to claim 1, wherein the pair of second clamping paws are extended slantwise so that free ends of the pair of second clamping paws are close to each other.

3. The connecting terminal of the coaxial connector according to claim 1, wherein the terminal body, the pair of first clamping paws and the pair of second clamping paws are integrally formed by a metal sheet.

4. A connecting terminal of a coaxial connector, comprising:

a terminal body having a solder cup and defining a first end and a second end in a longitudinal direction of the terminal body, the solder cup being shaped to hold solder for soldering a conductive core of the coaxial connector to the terminal body for transmission of signals through the connecting terminal;

a pair of first clamping paws disposed at the first end of the terminal body, opposed to each other in a transverse direction of the terminal body, and adjacent to the solder cup, the pair of first clamping paws being configured to clamp against the conductive core of the coaxial connector for transmission of signals through the connecting terminal; and a pair of second clamping paws disposed at the second end of the terminal body and opposed to each other in the transverse direction;

wherein the solder cup is an indented groove formed in an upper surface of the terminal body.

5. The connecting terminal of the coaxial connector according to claim 4, wherein the pair of second clamping paws are extended slantwise so that free ends of the pair of second clamping paws are close to each other.

6. The connecting terminal of the coaxial connector according to claim 4, wherein the terminal body, the pair of first clamping paws and the pair of second clamping paws are integrally formed by a metal sheet.

* * * * *